US005931243A

United States Patent [19]

Beccu

[11] Patent Number: 5,931,243

[45] Date of Patent: Aug. 3, 1999

[54] HAMMER DEVICE

[75] Inventor: Rainer Beccu, Houston, Tex.

[73] Assignee: Sandvik AB, Sandviken, Sweden

[21] Appl. No.: 08/852,610

[22] Filed: May 7, 1997

[30] Foreign Application Priority Data

May 9, 1996 [SE] Sweden ..... 9601762

[51] Int. Cl.[6] ..... E21B 4/14

[52] U.S. Cl. ..... 175/296; 173/126

[58] Field of Search ..... 175/293, 296, 175/424, 189; 173/90, 126

[56] References Cited

U.S. PATENT DOCUMENTS

| | | | |
|---|---|---|---|
| 3,570,609 | 3/1971 | Wise | 173/126 |
| 3,630,292 | 12/1971 | Vincent | 173/17 |
| 4,077,304 | 3/1978 | Bouyoucos | 91/276 |
| 5,305,841 | 4/1994 | Beccu | 175/189 |

OTHER PUBLICATIONS

Llundberg et al., "Influence of Geometrical Design on the Efficiency of a Simple Down–the–Hole Percussive Drill"; Int. J. Rock Mech. Min, Science & Geomech., vol. 23, No. 3, pp. 281–287, 1986.

*Primary Examiner*—Hoang C. Dang

*Attorney, Agent, or Firm*—Burns, Doane, Swecker & Mathis LLP

[57] ABSTRACT

The present invention relates to a hammer device, preferably a down-the-hole hammer, including a drill bit (11) and a piston (10) reciprocating therebehind to periodically strike the drill bit. The drill bit (11) includes front (11a) and rear (11b) portions of different impedance, and the piston (10) includes front (10b) and rear (10a) portions of different impedance. In the drill bit, the front portion (11a) has a larger impedance than the rear portion (11b). In the piston, the rear portion (10a) has a larger impedance than the front portion (10b). The length of the drill bit front portion (11a) is about twice the length of the drill bit rear portion (11b). The length of the piston rear portion (10a) is about twice the length of the piston front portion (11b). The invention further relates to a drill bit (11) and a piston (10), per se.

15 Claims, 5 Drawing Sheets

HAMMER DEVICE

BACKGROUND OF THE INVENTION

The present invention relates to a hammer device, preferably a down-the-hole hammer, including a casing, a piston, a drill bit and means for activating the piston to frequently strike the drill bit. The invention also relates to a piston and a drill bit per se.

In down-the-hole hammers the kinetic energy of the piston is transmitted by elastic waves through the drill bit and finally to the rock. However, said transmission is not carried out in an optimal way since the piston is not related to the drill bit in terms of length and mass. Also the drill bit does not cooperate with the rock in the best mode.

In prior art down-the-hole hammers very little attention has been paid to the adaptation of the piston to the drill bit when said drill bit has a mass concentration at the end directed towards the rock.

In applicants U.S. Pat. No. 5,305,841, however, the importance of choosing appropriate impedance on the cooperating drill bit and piston, is discussed. The document discloses a down-the-hole hammer, wherein the drill bit includes front and rear portions of different impedance, and the piston includes front and rear portions of different impedance. In the drill bit, the front portion has a larger impedance than the rear portion. In the piston, the rear portion has a larger impedance than the front portion. However the rear portion of the drill bit and the front portion of the piston include relatively small masses, which negatively affects the degree of efficiency during drilling. Furthermore, the known hammer device has been complicated to manufacture due to the requirements for guiding the elongated portions of the bit and the piston.

The objects of the present invention are to further improve the energy transmission from the piston to the rock via the drill bit and to facilitate the manufacture of the hammer device. This is realized by paying attention also to the distribution of the impedance in the piston and the drill bit of a hammer device as defined in the appending claims.

BRIEF DESCRIPTION OF THE DRAWINGS

Below an embodiment of a down-the-hole hammer according to the present invention is described, reference being made to the accompanying drawings, where FIG. 1 schematically discloses the piston and the drill bit of a down-the-hole hammer according to the present invention.

Figure 1:
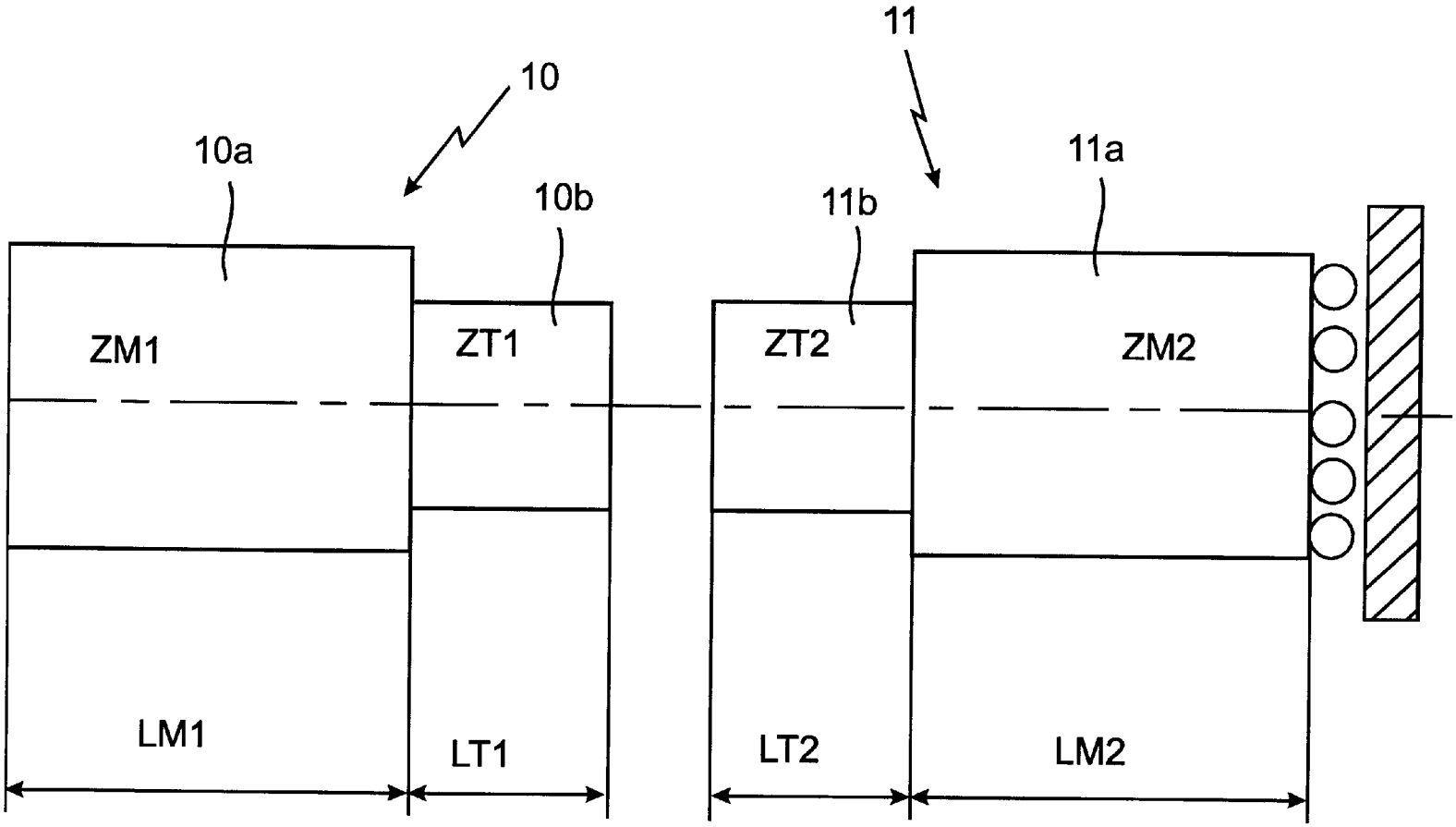
In FIG. 1 the piston 10 and the drill bit 11 are schematically shown. As is evident from FIG. 1 the piston 10 and the drill bit 11 have a substantially reversed design relative to each other.

The piston 10 has two portions 10*a* and 10*b*. The portion 10*a* has the length $L_{M1}$ and the impedance $Z_{M1}$ while the portion 10*b* has the length $L_{T1}$ and the impedance $Z_{T1}$. The drill bit 11 has two portions 11*a* and 11*b*. The portion 11*a*, i.e. the head of the drill bit, has the length $LM_2$ and the impedance $Z_{M2}$ while the portion 11*b*, i.e. the shaft of the drill bit, has the length $L_{T2}$ and the impedance $Z_{T2}$.

When stress wave energy is transmitted through pistons and drill bits it has been found that the influence by variations in the cross-sectional area A, the Young's modulus E and the density δ can be summarized in a parameter Z named impedance. The impedance Z=AE/c, where $c=(E/\delta)^{1/2}$, i.e. the elastic wave speed. Any combinations of A, E and δ that corresponds to a certain value of the impedance Z gives the same result in respect of stress wave energy transmission.

It should be pointed out that the impedance Z is determined in a certain cross-section transverse to the axial direction of the piston 10 and the drill bit 11, i.e. the impedance Z is a function along the axial direction of the piston 10 and the drill bit 11.

Therefore, within the scope of the present invention it is of course possible that the impedances Z for the different portions 10*a*, 10*b*, 11*a* and 11*b* may vary slightly, i.e. $Z_{M1}$, $Z_{T1}$, $Z_{T2}$ and $Z_{M2}$ do not need to have a constant value within each portion but can vary in the axial direction of said portions 10*a*, 10*b*, 11*a* and 11*b*. In the practical design of the piston 10 and the drill bit 11 the provision of e.g. circumferential grooves and/or splines are quite frequent. Also the provision of e.g. a circumferential shoulder may be necessary.

It should also be pointed out that even if e.g. the portions 10*a* and 10*b* must have different impedances $Z_{M1}$ and $Z_{T1}$ respectively it is possible to design the piston 10 with a generally constant cross-sectional area by using different materials in the portions 10*a* and 10*b*.

It is also necessary to define a further parameter, namely a time parameter T. The definition is T=L/c, where L is the length of the portion in question and c is the elastic wave speed in the portion in question. Thus for the portion 10*a* $T_{M1}=L_{M1}/c_{M1}$, for the portion 11*a* $T_{M2}=L_{M2}/c_{M2}$, for the portion 10*b* $T_{T1}=L_{T1}/cT_1$ and for the portions 11*b* $T_{T2}=L_{T2}/c_{T2}$. The reason why it is necessary to have the time parameter T instead of the length L is that different portions may consist of different materials that have different values regarding the elastic wave speed c.

Within the scope of the present invention it is also possible that e.g. the portion 10*a* can consist of several sub-portions having different elastic wave speed c. In such a case the time parameter T is calculated for each sub-portion and the total value of the time parameter T for the entire portion 10*a* is the sum of the time parameters T for each sub-portion.

Figure 2:
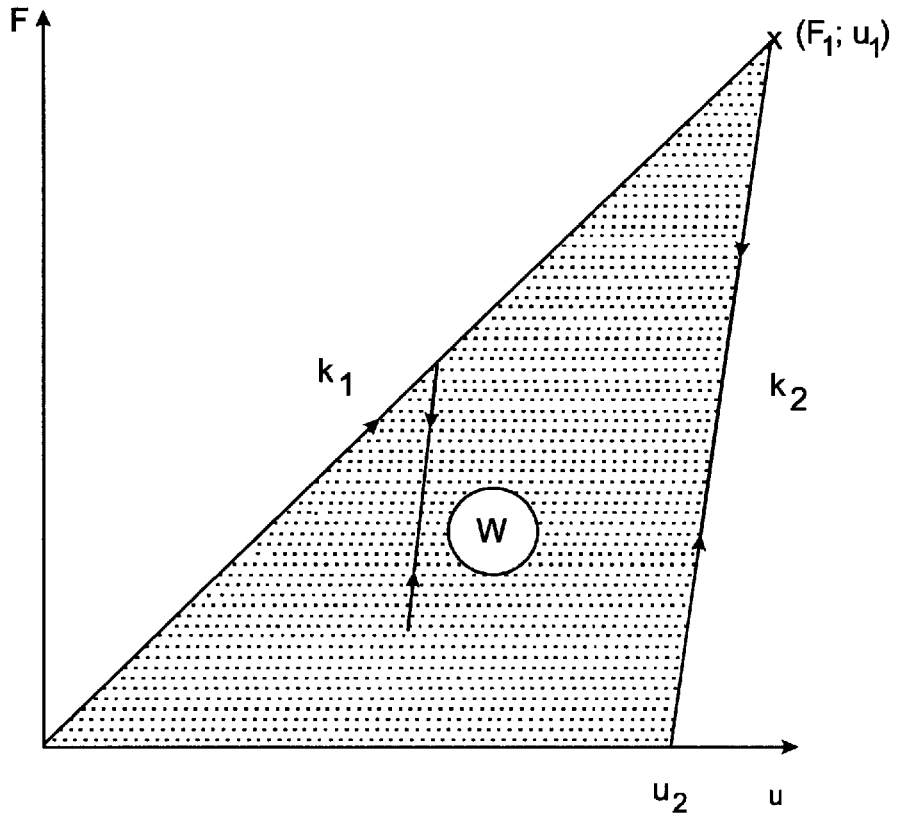
FIG. 2 discloses the relationship between the applied force versus the penetration for a drill bit working a rock surface.

FIG. 2 shows the relationship between the force F applied to the rock versus the penetration u into the rock. The line $k_1$ illustrates the relation between the force F and the penetration u when a force F is loaded to the rock. Thus $k_1$=F/u during the loading sequence and $k_1$ is a constant. The force $F_1$ corresponds to the penetration $u_1$. The unloading of the force F is illustrated by the line $k_2$. Thus $k_2$=F/u during the unloading sequence and $k_2$ is a constant. When complete unloading has taken place there is a remaining penetration $u_2$ which means that a certain work has been carried out upon the rock, said work being illustrated by the triangular dotted area. The amount of work that said area represents is defined as W.

The kinetic energy of the piston 10 when moving towards the drill bit 11 is defined as Wk.

As stated above the aim of the present invention is to maximize the degree of efficiency, which is defined as the relationship $W/W_k$.

The present invention is based on the idea that the mass distribution of the piston 10 is such that initially a smaller mass, i.e. the portion 10*b* is contacting the drill bit 11. Subsequently, a larger mass, i.e. the portion 10*a*, follows. It has turned out that by such an arrangement almost all of the kinetic energy of the piston is transmitted into the rock via the drill bit.

The most important parameter is the impedance ratios $Z_{M1}/Z_{T1}$ and $Z_{M2}/Z_{T2}$. Said parameter should be in a certain interval. In order to have an optimum degree of efficiency it is also important that the time parameter ratios $T_{M1}/T_{T1}$ and $T_{M2}/T_{T2}$ are in a certain interval.

Figure 3:
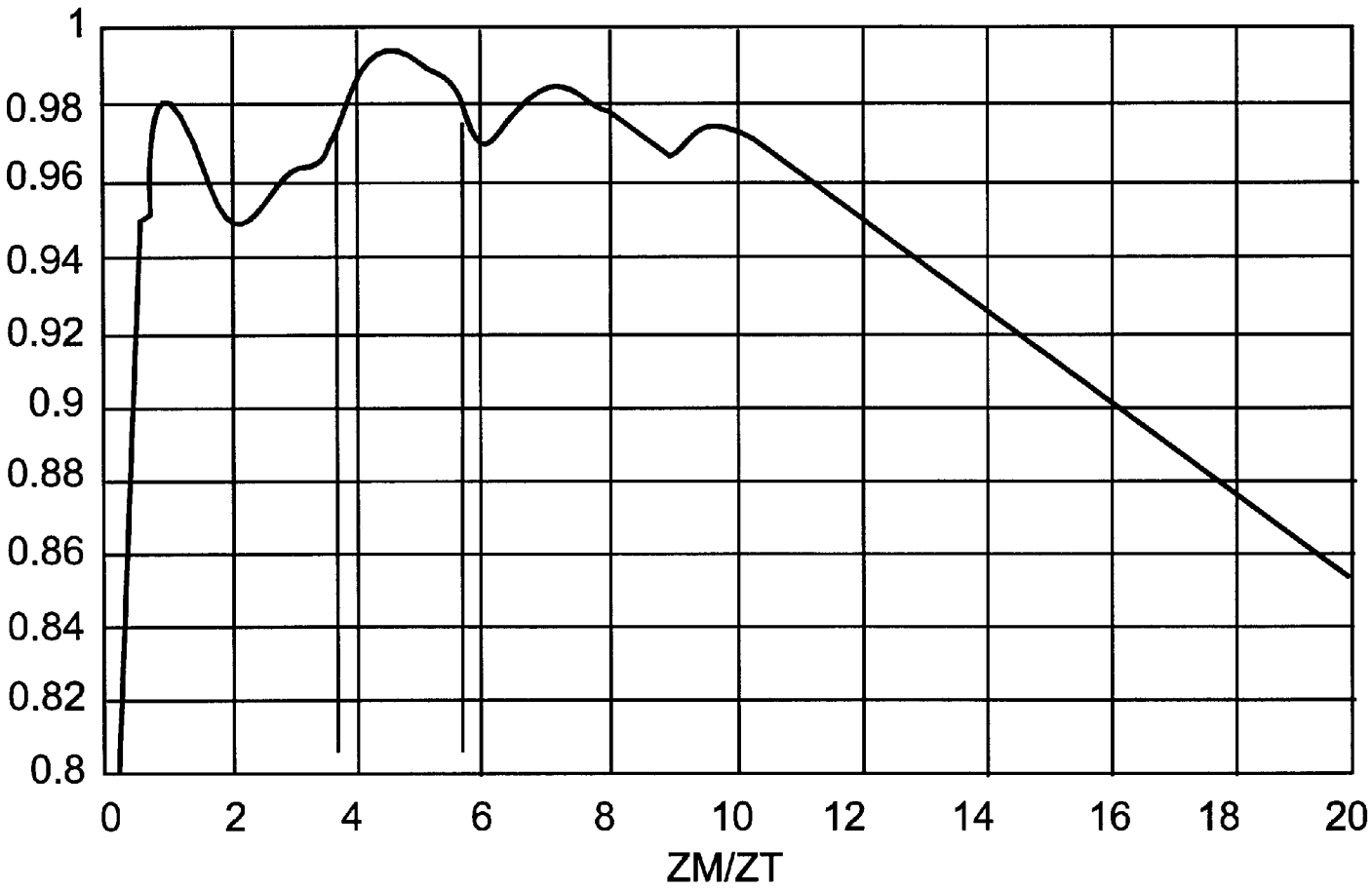
FIG. 3 discloses in a graph the relationship between the degree of efficiency versus the relationship ZM/ZT.

In FIG. 3 a graph shows the relationship between the degree of efficiency W/Wk versus the impedance ratio ZM/ZT, said ratio being valid for both the piston 10 and the drill bit 11. When setting up the graph in FIG. 3, $T_M/T_T=2$ and $\beta=0.5$, see below concerning definition of $\beta$. As can be learnt from FIG. 3 the efficiency peak is within the interval 3.5–5.8, preferably 4.0–5.3 of ZM/ZT. In said preferred interval the degree of efficiency $W/W_k$ is higher than 96%. The highest degree of efficiency $W/W_k$ in said interval is achieved when ZM/ZT is about 4.6.

Since the degree of efficiency $W/W_k$ has its peak when ZM/ZT is about 4.6 it can be concluded that the theoretically preferred design is when the different portions 10*a*, 10*b* and 11*a*, 11*b* of the piston 10 and drill bit 11, respectively, each have a constant impedance Z in their axial directions. Also the portions 10*a* and 11*a* should have the same impedance and the portions 10*b* and 11*b* should have the same impedance. However, this is not likely to happen in the practical embodiments, see above. Therefore, it should again be emphasized that the impedances $Z_{M1}$, $Z_{T1}$, $Z_{T2}$ and $Z_{M2}$ need not have constant values but can vary in the axial direction of the corresponding portions 10*a*, 10*b*, 11*a* and 11*b*, respectively. The only restriction is that the ratios $Z_{M1}/Z_{T1}$ and $Z_{M2}/Z_{T2}$ are in the intervals specified in the appending claims.

Figure 4:
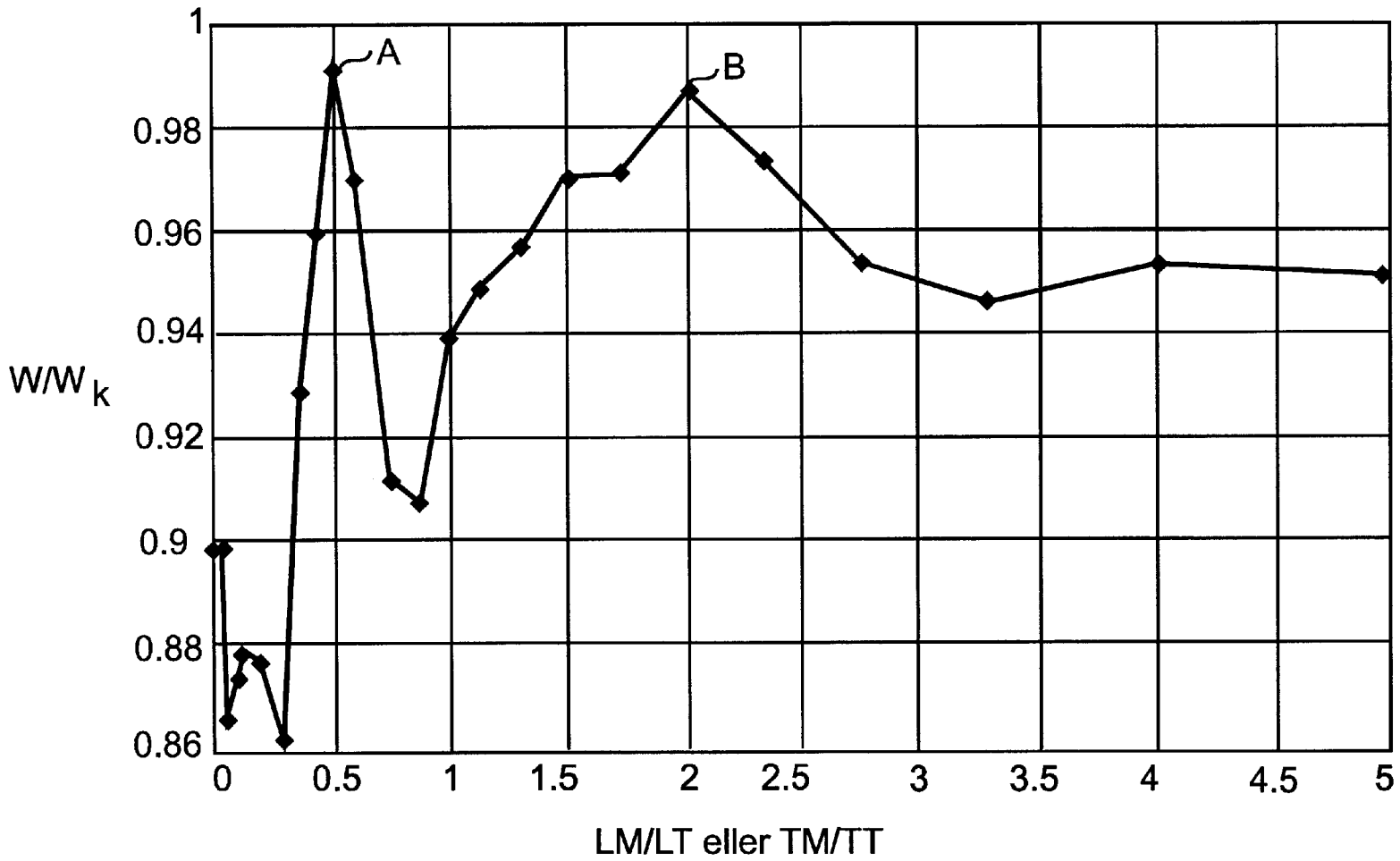
FIG. 4 discloses in a graph the relationship between the degree of efficiency versus the relationship $L_M/L_T$ or $T_M/T_T$.

In FIG. 4 a graph shows the relationship between the degree of efficiency $W/W_k$ versus the length ratio $L_M/L_T$ or the time ratio $T_M/T_T$, said ratios being valid for both the piston 10 and the drill bit 11. When setting up the graph in FIG. 4, ZM/ZT=4.6 and $\beta=1$, see below for definition of $\beta$. As can be learnt from FIG. 4 the first peak A of $W/W_k$ is within the interval 0.4–0.6 of $L_M/L_T$ or $T_M/T_T$. In said interval the degree of efficiency $W/W_k$ is well over 90%. The highest degree of efficiency is achieved, according to our prior patent to benefit from the first peak A, when $L_M/L_T$ or $T_M/T_T=0.5$.

So far, the present description coincides with the state of the art as disclosed in U.S. Pat. No. 5,305,841. We have, however, searched for and found a second peak B, outside the borders of the graph in FIG. 4 of said prior patent. The second peak B can be somewhat lower than the first peak A but peak B is much wider than peak A. The large width of peak B makes the manufacturing of the hammer device according to the present invention less sensitive to the provision of grooves, shoulder and/or splines. For example if the efficiency shall be 96% or more, the ratio between LM and LT (or between TM and TT) can vary within only 0.43 to 0.60 for the peak A area, while it can vary between 1.34 to 2.61 for the peak B area. That is, the peak B area is at least about 7 times the peak A area at a degree of efficiency not less than 96%, which makes the hammer device efficiency less sensitive to disturbing additions, such as grooves, etc. The optimum design is when $T_{M1}$ is equal to $T_{M2}$ and $T_{T1}$ is equal to $T_{T2}$. A further advantage with increasing the lengths of the portions 10*a* and 11*a* is that the total kinetic mass will increase, i.e. will give more power in each impact, compared to the hammer device of the prior patent.

When using the findings according to this invention as regards the impedance ratio ZM/ZT and the time ratio $T_M/T_T$ in dimensioning work it is also necessary to introduce a parameter named $\beta$. Said parameter $\beta=2L_H k_1/A_{T2}E_{T2}$, where $L_H=L_{T2}+L_{M2}$; $k_1$ is the constant illustrated in FIG. 2; $A_{T2}$ is the cross-sectional area of the portion 11*b*; and $E_{T2}$ is the Young's' modulus for the portion 11*b*.

Figure 5:
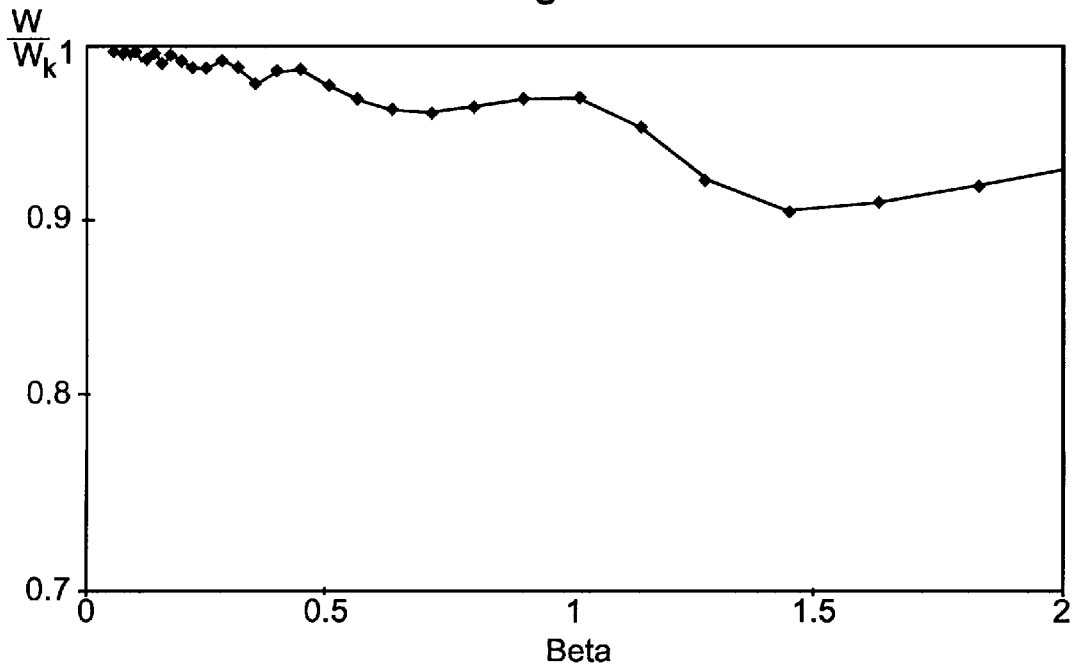
FIG. 5 discloses in a graph the relationship between the degree of efficiency versus the parameter β.

In FIG. 5 the relationship of the degree of efficiency $W/W_k$ versus the parameter $\beta$ is shown. When setting up the graph of FIG. 5 ZM/ZT=4.6 and $T_M/T_T=2$. From FIG. 5 it can be learnt that the degree of efficiency $W/W_k$ decreases for an increasing value of $\beta$. Therefore it is important that proper matching values for $L_H$ and $A_{T2}$ are chosen and also that a material having a proper Young's' modulus $E_{T2}$ is chosen. For practical reasons it is not possible to give $\beta$ a too small value although the degree of efficiency $W/W_k$ increases for a decreasing value of $\beta$.

Figure 6:
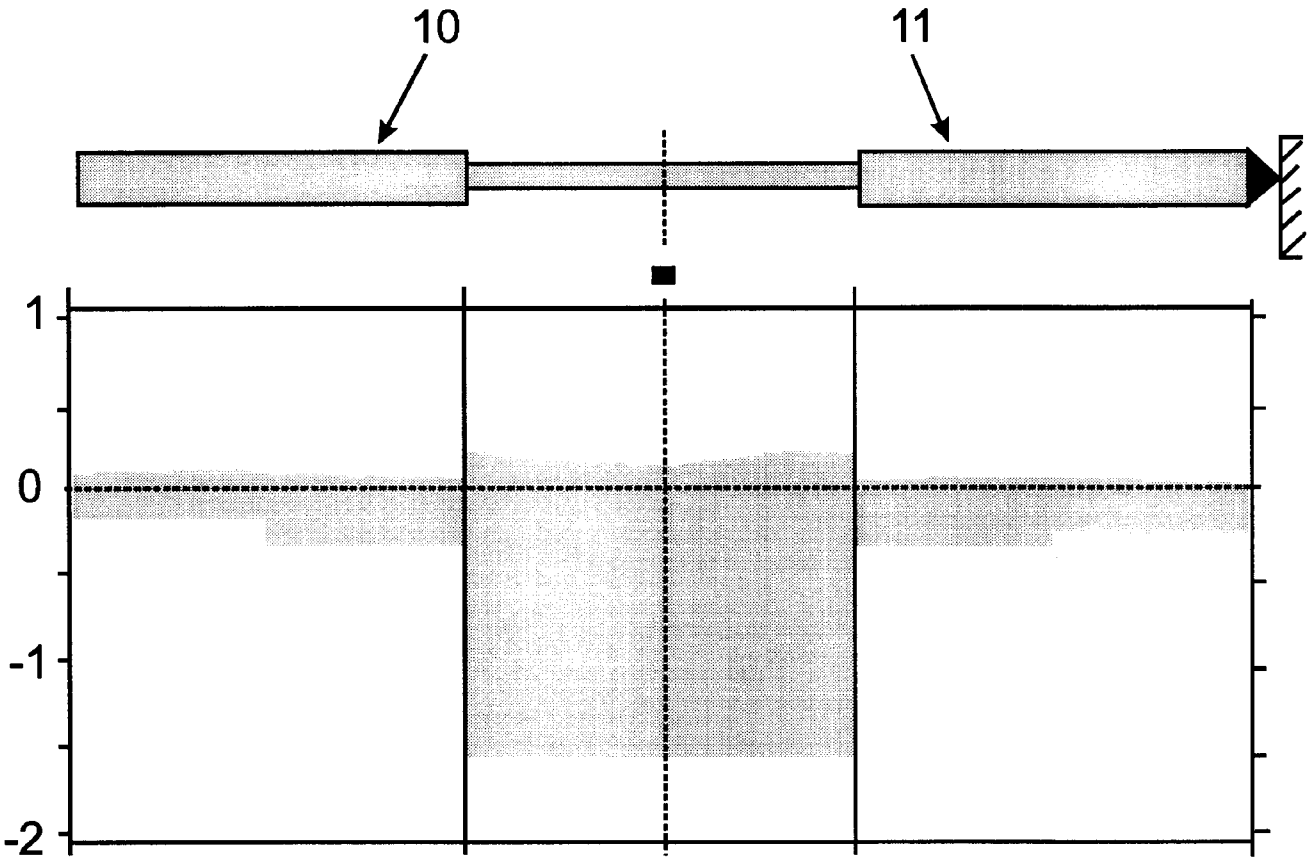
FIG. 6 discloses a graph showing the compressive and tensile stresses in the piston and the drill bit.

A very important favorable feature of the present invention is that the piston and the drill bit of a hammer device according to the present invention are not subjected to any tensile stresses worth mentioning during the rock crushing work period of the stress wave. Thus the original stress wave can be reflected several times within the system without generating any tensile stress waves worth mentioning. In FIG. 6 the highest positive (tensile) stress and the highest negative (compressive) stress in every cross-section of the piston 10 and drill bit 11 are shown. In the graph the shown stresses are dimensionless since they are related to a reference stress. From FIG. 6 it can be seen that generally only the piston front portion 10*b* and the drill bit rear portion 11*b* are subjected to tensile stresses and that the values of said stresses are negligible. It should be pointed out that since tensile stresses are almost absent in the piston and drill bit according to the present invention said details will have a longer life than corresponding details in a conventional down-the-hole hammer. It is the tensile stresses that give rise to fatigue of details of that kind.

The graphs according to FIGS. 3, 4 ,5 and 6 have been set up by using a computer program simulating percussive rock drilling. However, the computer program has only been used to verify the theories of the present invention, namely to have a reversed design of the piston 10 and the drill bit 11.

It should be pointed out that the present invention is in no way restricted to a down-the-hole hammer but is also applicable in e.g. so called impact breakers and hard rock excavating machines. Generally speaking the invention can be used in a piston-drill bit system where the piston is acting directly upon the drill bit. Also there is no limitation concerning the activation of the piston. This means that such activation can be effected by e.g. a hydraulic medium, by air or by any other suitable means.

Although the present invention has been described in connection with a preferred embodiment thereof, it will be appreciated by those skilled in the art that additions, deletions, modifications, and substitutions not specifically described may be made without departing from the spirit and scope of the invention as defined in the appended claims.

I claim:

1. In a hammer device comprising a drill bit disposed at a front end of the device, and a piston mounted longitudinally behind said drill bit for reciprocation in a longitudinal direction to repeatedly strike said drill bit, said drill bit including front and rear portions of different impedance, and said piston including front and rear portions of different impedance, wherein $Z_{M1}/Z_{T1}$ is in the range of 3.5–5.8, and $Z_{M2}/Z_{T2}$ is in the range of 3.5–5.8, where $Z_{M1}$ is the impedance of said piston rear portion, where $Z_{T1}$ is the impedance of said piston front portion, where $Z_{M2}$ is the impedance of said drill bit front portion, and where $Z_{T2}$ is the impedance of said drill bit rear portion, wherein:

$L_{M1}/L_{T1}$ or $T_{M1}/T_{T1}$ is in the range of 1.0–3.0, and $L_{M2}/L_{T2}$ or $T_{M2}/T_{T2}$ is in the range of 1.0–3.0, where:

$L_{M1}$ is the length and $T_{M1}$ is the time parameter of said piston rear portion, $L_{T1}$ is the length and $T_{T1}$ is the time parameter of said piston front portion, $L_{M2}$ is the length and $T_{M2}$ is the time parameter of said drill bit front portion, $L_{T2}$ is the length and $T_{T2}$ is the time parameter of said drill bit rear portion.

2. Hammer device according to claim 1, wherein the ratios $Z_{M1}/Z_{T1}$ and $Z_{M2}/Z_{T2}$ are in the interval 4.0–5.3, and that the ratio $L_{M2}/L_{T2}$ or $T_{M2}/T_{T2}$ is about 2 and that $Z_{M1}$ is equal to $Z_{M2}$ and $Z_{T1}$ is equal to $Z_{T2}$.

3. Hammer device according to claim 1, wherein the piston and the drill bit have a reversed design relative to each other in respect of the time parameter or the length parameter.

4. Hammer device according to claim 1, wherein $L_{M1}/L_{T1}$ or $T_{M1}/T_{T1}$ is in the range of 1.5–2.5.

5. Hammer device according to claim 1, wherein $L_{M2}/L_{T2}$ or $T_{M2}/T_{T2}$ is in the range of 1.5–2.5.

6. Hammer device according to claim 4, wherein $L_{M2}/L_{T2}$ or $T_{M2}/T_{T2}$ is in the range of 1.5–2.5.

7. Hammer device according to claim 2, wherein the ratios $Z_{M1}/Z_{T1}$ and $Z_{M2}/Z_{T2}$ are in the magnitude of 4.6.

8. Piston for use in a hammer device for being reciprocated longitudinally into striking engagement with a drill bit located in the front of the piston, said piston including front and rear portions of different impedance wherein $Z_{M2}/Z_{T1}$ is in the range of 3.5–5.8, where $Z_{M2}$ is the impedance of said piston rear portion, where $Z_{T1}$ is the impedance of said piston front portion, wherein $L_{M1}/L_{T1}$ or $T_{M1}/T_{T1}$ is in the range of 1.0–3.0, where:

$L_{M1}$ is the length and $T_{M1}$ is the time parameter of said piston rear portion, $L_{T1}$ is the length and $T_{T1}$ is the time parameter of said piston front portion.

9. Piston according to claim 8, wherein the ratio $L_{M1}/L_{T1}$ or $T_{M1}/T_{T1}$ is about 2.

10. Piston according to claim 8, wherein $L_{M1}/L_{T1}$ or $T_{M1}/T_{T1}$ is in the range of 1.5–2.5.

11. Drill bit for use in a hammer device for being repeatedly struck by a longitudinally reciprocating piston located behind said drill bit, said drill bit including front and rear portions of different impedance, wherein $Z_{M2}/T_{T2}$ is in the range of 3.5–5.8, where $Z_{M2}$ is the impedance of said drill bit front portion, where $Z_{T2}$ is the impedance of said drill bit rear portion, wherein $L_{M2}/L_{T2}$ or $T_{M2}/T_{T2}$ is in the range of 1.0–3.0, where:

$L_{M2}$ is the length and $T_{M2}$ is the time parameter of said drill bit front portion, $L_{T2}$ is the length and $T_{T2}$ is the time parameter of said drill bit rear portion.

12. Drill bit according to claim 11, wherein the ratio $L_{M2}/L_{T2}$ or $T_{M2}/T_{T2}$ is about 2.

13. Drill bit according to claim 11, wherein the hammer device is a down-the-hole hammer.

14. Drill bit according to claim 11, wherein $L_{M2}/L_{T2}$ or $T_{M2}/T_{T2}$ is in the range of 1.5–2.5.

15. Drill bit according to claim 13, wherein $L_{M2}/L_{T2}$ or $T_{M2}/T_{T2}$ is in the range of 1.5–2.5.

* * * * *

UNITED STATES PATENT AND TRADEMARK OFFICE

CERTIFICATE OF CORRECTION

PATENT NO. : 5,931,243
DATED : August 3, 1999
INVENTOR(S) : Beccu, Rainer

It is certified that error appears in the above-identified patent and that said Letters Patent is hereby corrected as shown below:

Column 6,
Line 20, change "$\mathbf{Z}_{m2}/\mathbf{T}_{T2}$" to read -- $\mathbf{Z}_{m2}/\mathbf{Z}_{T2}$ --

Signed and Sealed this

Ninth Day of August, 2005

JON W. DUDAS
*Director of the United States Patent and Trademark Office*